US011810481B2

(12) United States Patent
Gerace

(10) Patent No.: US 11,810,481 B2
(45) Date of Patent: Nov. 7, 2023

(54) EVIDENCE SCENE MARKING METHOD AND APPARATUS

(71) Applicant: Vincent J Gerace, Jamestown, NY (US)

(72) Inventor: Vincent J Gerace, Jamestown, NY (US)

( * ) Notice: Subject to any disclaimer, the term of this patent is extended or adjusted under 35 U.S.C. 154(b) by 0 days.

(21) Appl. No.: 17/648,111

(22) Filed: Jan. 14, 2022

(65) Prior Publication Data

US 2022/0139267 A1 May 5, 2022

Related U.S. Application Data

(63) Continuation-in-part of application No. 16/510,704, filed on Jul. 12, 2019, now abandoned.

(51) Int. Cl.
*G09F 3/02* (2006.01)
*G09F 3/10* (2006.01)

(52) U.S. Cl.
CPC ..... *G09F 3/02* (2013.01); *G09F 3/10* (2013.01); *G09F 2003/0202* (2013.01); *G09F 2003/0279* (2013.01)

(58) Field of Classification Search
CPC ..... G09F 1/02; G09F 1/10; G09F 1/06; G09F 7/00; G09F 3/02; G09F 3/10; G09F 2003/0202; G09F 2003/0279; E01F 9/654; E01F 9/688; E01F 9/692; G01N 2001/007
See application file for complete search history.

(56) References Cited

U.S. PATENT DOCUMENTS 3,664,910 A * 5/1972 Hollie ..... A61B 5/1172 428/41.7
4,060,929 A * 12/1977 Meyer ..... A63H 33/30 446/219
4,173,086 A * 11/1979 Hempfling ..... G09F 7/18 40/607.03
4,291,882 A * 9/1981 Del Monte ..... A63F 3/06 273/148 A
4,772,869 A * 9/1988 Grammas ..... B60Q 7/00 116/63 C
D359,699 S * 6/1995 Vandergrift ..... D10/70
5,787,616 A * 8/1998 Rogers ..... G09F 1/06 116/209
5,915,852 A * 6/1999 Rogers ..... G09F 1/06 40/124.01
6,149,111 A * 11/2000 Epstein ..... A47G 33/12 248/152
6,243,958 B1 * 6/2001 Ringley, Jr. ..... G09F 15/0056 116/209
6,349,667 B1 * 2/2002 Rogers ..... A63C 9/06 116/173
6,618,969 B1 * 9/2003 Rogers ..... G09F 1/06 40/124.16

(Continued)

*Primary Examiner* — Patrick D Hawn

(57) ABSTRACT

A marking system for marking evidence at a scene is provided including a plurality of markers, and a plurality of different types of holders adapted to secure the plurality of markers in marking environments including a relatively horizontal surface, a relatively vertical surface, a relatively slanted surface, a vehicle surface, and a magnetic surface. The markers may include measurement indicia, a sequential marker identification, an index for indication of orientation, and/or a logo.

5 Claims, 5 Drawing Sheets

(56) References Cited

U.S. PATENT DOCUMENTS

| | | | | |
|---|---|---|---|---|
| 6,880,277 | B2 * | 4/2005 | Kaminski | G09F 7/00 40/584 |
| 6,935,059 | B1 * | 8/2005 | Chang | G09F 7/18 256/1 |
| 7,452,142 | B1 * | 11/2008 | Smith | G03B 17/00 33/266 |
| 7,823,526 | B2 * | 11/2010 | Julnes | E01F 9/688 116/63 C |
| 7,997,808 | B1 * | 8/2011 | Smith | F16M 11/2092 396/422 |
| 8,166,663 | B2 * | 5/2012 | Elias | G01B 3/566 33/474 |
| 8,302,551 | B2 * | 11/2012 | Julnes | E01F 9/688 116/63 C |
| 8,359,759 | B2 * | 1/2013 | Schneider | B43L 7/027 33/484 |
| 10,410,546 | B2 * | 9/2019 | Vandergrift | G09F 7/18 |
| 2008/0120859 | A1 * | 5/2008 | Eversdijk | G09F 7/00 33/483 |
| 2015/0266018 | A1 * | 9/2015 | Sangha | B01L 9/52 435/6.1 |
| 2016/0024559 | A1 * | 1/2016 | Sangha | G01N 1/405 436/176 |
| 2017/0234778 | A1 * | 8/2017 | Sangha | B01L 3/5029 435/6.11 |
| 2021/0012683 | A1 * | 1/2021 | Gerace | G09F 1/10 |

* cited by examiner

EVIDENCE SCENE MARKING METHOD AND APPARATUS

SUMMARY

Figure 1A:
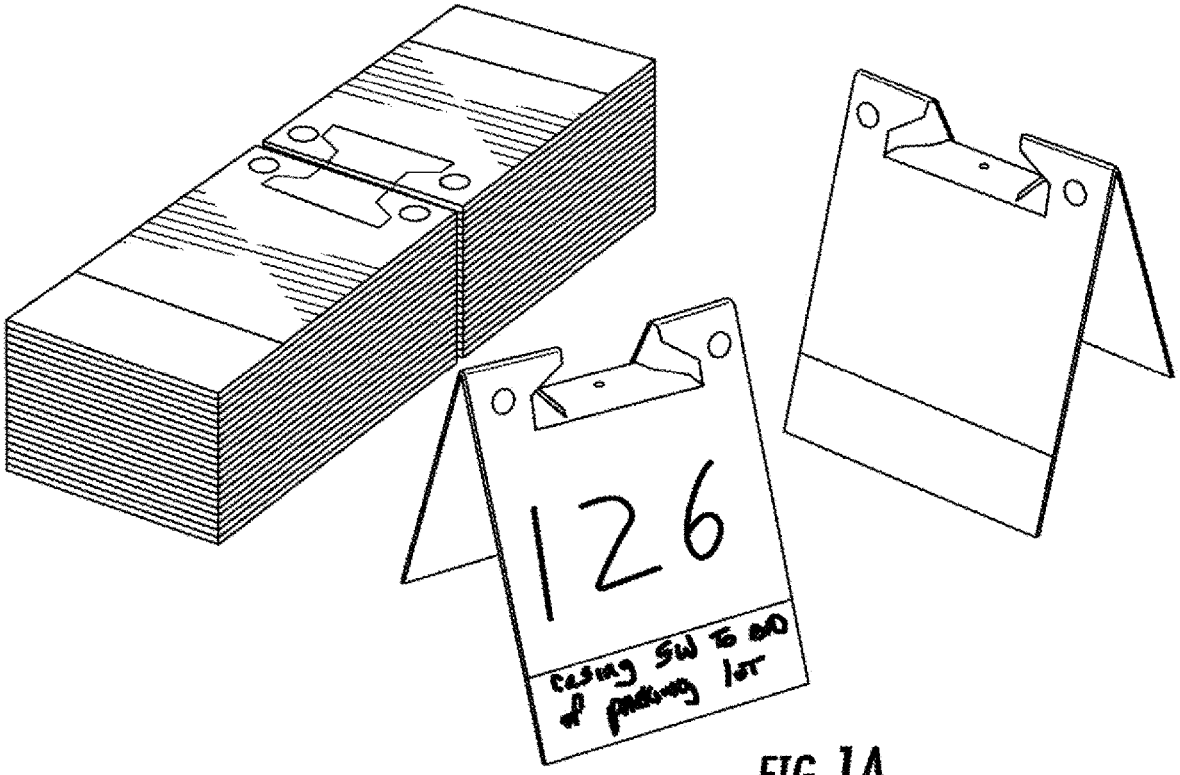
FIG. 1A (PRIOR ART)
FIGS. 1A and 1B show prior art evidence marker solutions.

The present application is directed to a marking system for marking evidence at a scene, such as but not limited to a crime scene. The system includes a plurality of markers, with each marker having a thickness of between about 0.127 and about 1.270 millimeters, at least one linear edge, at least one measurement indicia, a sequential marker identification, and an index for indication of orientation. The marking system includes a plurality of different types of holders adapted to secure the plurality of markers in different marking environments. Those marking environments may include a relatively horizontal surface, a relatively vertical surface, a relatively slanted surface, a vehicle surface, and a magnetic surface. In this context, "relatively" means within a fifteen-degree (15°) angle of the corresponding orientation; for example, if "vertical" is taken to mean at a ninety-degree angle to the horizontal, "relatively vertical" means at an angle of from seventy-five degrees (75°) to one-hundred and five degrees (105°) to the horizontal.

Each of the plurality of markers has a thickness of from about 0.170, or about 0.254, or about 0.330, or about 0.381 millimeters, to about 1.016, or about 0.889, or about 0.762, or about 0.635 millimeters. In particular but without limitation, each marker may have a thickness of from about 0.170 to about 0.330 millimeters.

A first type of holder includes walls and a groove formed therebetween for holding a corresponding marker, where each groove includes projections adapted to provide a gripping action for the marker. The base of the holder may include, for example, a weight, an adhesive, and/or a magnet to assist in associating the holder with a particular environment. Alternatively or in addition, the holder may include a one- or two-sided strip of removeable adhesive adapted to secure the holder to a surface. For a two-sided strip of adhesive, one side may be adapted to be secured to a side of a marker, and the other side may be adapted to be secured to a surface at the scene. The adhesive may be readily removeable, such as that used in the 3M "Command™" line of products.

In another embodiment a first type of holder may include a first end adapted to being positioned at a location of the scene, and a second end adapted to hold the linear edge of a marker through tension on the linear edge. The first end may be adapted to be pushed or driven into a penetrable surface, such as earth, at the scene, as by having a pointed end. The tension may be supplied in any suitable manner, including a spring-clip arrangement.

Each marker my include one or more of a law enforcement agency logo, a progress indicator to show the current status of a corresponding piece of evidence, and/or a scale printed on an outer edge thereof for indicating the dimensions of the evidence holder. The holder may be a cone having a groove formed therein for retaining the linear edge of a marker.

It is understood that while all markers and holders in the present marking system may be the same or identical, in many cases it will be preferable to provide different types of holders to enable placing the markers in a range of environments, including on the ground, on a horizontal surface, on a vertical surface, on a slanted surface, and on a vehicle. In this way the present marking system may be used to mark a range of evidence locations, while using the same markers. The use of the same markers in a given scene may also be useful in viewing photographs taken of a marked scene, because knowing that all of the markers have the same dimensions (and, optionally the same scale markings) will assist in determining distances, and sizes of objects, in a given photograph.

The present application is also directed to method of marking evidence at a scene with the present marking system. This method included providing a plurality of markers, each marker having a thickness of between about 0.127 and about 1.270 millimeters, at least one linear edge, at least one measurement indicia, a sequential marker identification, and an index for indication of orientation. Also provided are a plurality of different types of holders adapted to secure the plurality of markers in different marking environments, including a relatively horizontal surface, a relatively vertical surface, a relatively slanted surface, a vehicle surface, and a magnetic surface. Each item of evidence is marked using a marker and the type of holder adapted to the environment of the item of evidence. Each marker may have a thickness of from about 0.170 to about 0.330 millimeters.

For purposes of the present disclosure, the term "about" means plus or minus ten percent (10%) of the indicated value. For example, "about 0.170" includes a range of from 0.153 to 0.187.

A first type of holder for use in this method may include walls and a groove formed therebetween for holding a corresponding marker, with each groove including projections adapted to provide a gripping action for the marker. The base of each holder may include at least one of a weight, an adhesive, and a magnet.

The markers may further include a law enforcement agency logo, a progress indicator to show the current status of a corresponding piece of evidence, and/or a scale printed on an outer edge thereof for indicating the dimensions of the evidence holder.

The present method extends to compiling an evidence kit from the plurality of makers and plurality of holders.

DETAILED DESCRIPTION

The present evidence markers can be made from paper or plastic card stock or any other suitable printable medium. The size and shape of the markers is flexible. Shape can be customized to reflect the logo, badge configuration, or other identifier of the user involved, including but not limited to a first responder, such as police or other law enforcement agency (LEA) or fire department; military branch/authority; civil or private investigator; coroner; medical examiner; scientist; researcher; contractor; and so on. The most common shapes include rectangular, round, diamond, triangular but any geometric shape can be used. The evidence markers may be substantially planar, similar to a playing card, or three-dimensional, such as L-shaped or Z-shaped.

Markers may be custom designed and printed by the user or supplier in any desired quantity. Holders and stands may be specifically designed and produced for use with the markers, or improvised from available materials.

Figure 1B:
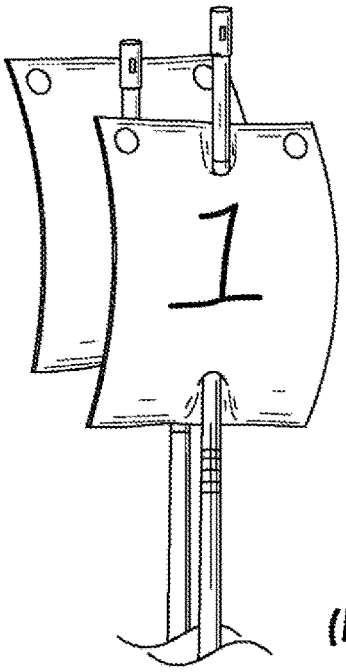
FIG. 1B (PRIOR ART)

Turning to the drawings, FIGS. 1A and 1B depict two prior art evidence markers used for marking evidence at crime scenes. FIG. 1A, utilizes stand-alone tent-like cards, providing a space for an investigator to designate the article of evidence with an identifier such as a numeral, as well as other pertinent information. FIG. 1B depicts another type of evidence marker card utilizing a pole-like structure to secure the marker adjacent to an article of evidence.

Figure 2:
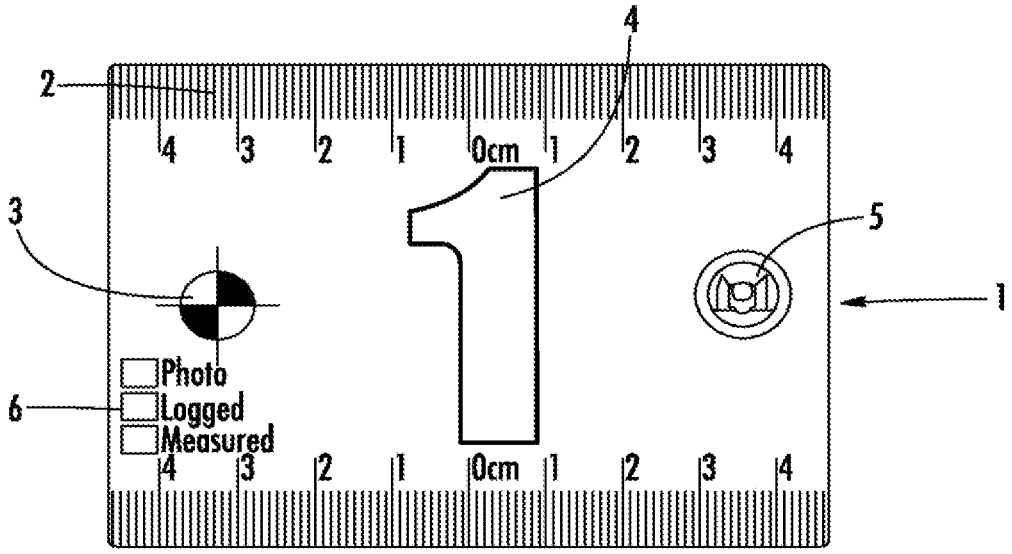
FIG. 2 illustrates one embodiment of the present evidence marker.

FIG. 2 illustrates one embodiment of the present evidence marker. As shown in FIG. 2, the present evidence markers typically are yellow in color. However, any color may be used including white, orange, green, etc. In addition, the markers may be manufactured from any suitable material including but not limited to paper (card stock) or plastic, and may be of any size, including without limitation: Bridge size (2.25.times.3.5"), Poker size (2.5.times.3.5"), Large size (3.5.times.5.75"), and Tarot size (2.75.times.4.75").

As shown in FIG. 2, each evidence marker 1 may contain graphic content providing one or more of: measurement indicia (English, metric, or other) 2; a perpendicular index for indication of orientation 3; a marker identifier 4 (usually sequential, such as a letter, number, or both); 5 logo or other identifier; and 6 markable progress indicators to show current status of the evidence, for example Photographed, Logged, or Measured.

The presence of measurement indicia on a marker can be useful in determining relative and/or absolute distances and sizes of items in photos taken of the scene in which markers appear. If the markers used in a scene are all the same size, such uniformity may assist in later assessment or interpretation of photos on the scene in which the markers appear. Independent of measurement indicia, knowing the size of the markers, and knowing that the markers are the same size, can assist in determining the distance between items in a photo, and or the dimensions of items appearing in a photo.

FIGS. 3A-3D show how the present evidence markers may be associated with evidence by a variety of means including: placing the evidence markers on an adjacent surface, whether ground or other; placing the evidence marker in a holder which rests on an adjacent surface; or placing the evidence marker in a holder attached to an adjacent surface, such as magnetically or adhesively.

Figure 3A:
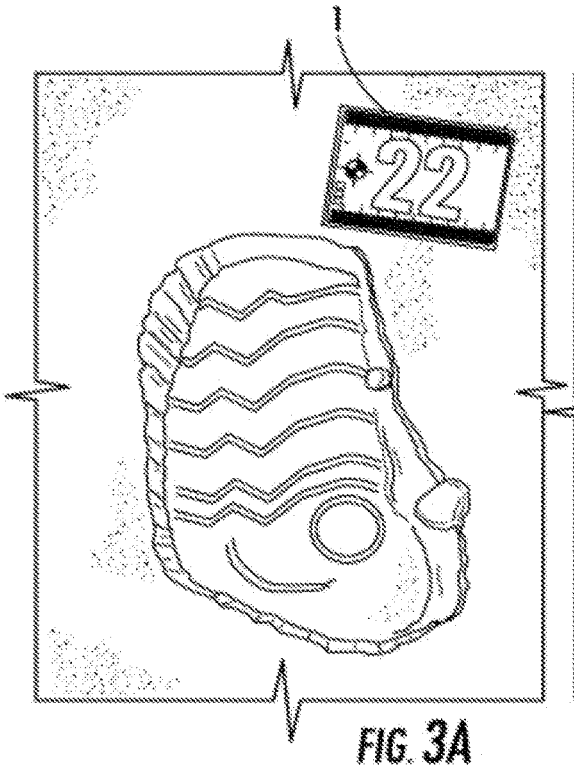
FIGS. 3A-3D illustrate how the present evidence marker may be securely affixed to evidence.
Figure 3B:
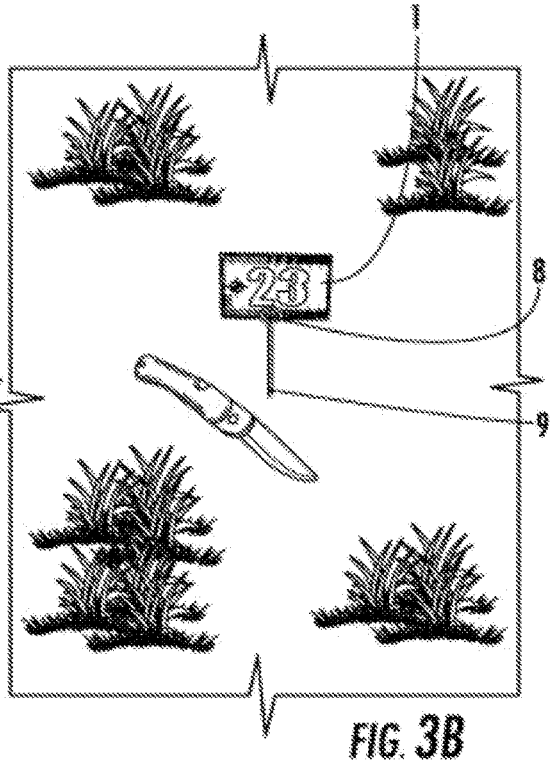

In particular, FIG. 3A illustrates how an evidence marker 1 may be securely placed next to a footprint in soil, including but not limited to by use of a tack, pin, nail, or other penetrating object 7 inserted through the marker and into the soil (or other underlying yielding surface). FIG. 3B illustrates another embodiment for securely holding an evidence marker next to an object located outdoors by means of holder 8 supported by a holder or platform 9. In this instance holder 8 has a first end for insertion into the yielding surface, such as by ending in a point and/or being of a sufficiently strong and rigid material to be driven into the yielding surface by foot or by a hammering action, and a second end for holding the marker. The second end can be any configuration suitable for securely holding a linear edge of a marker having the thickness in use, and may include but is not limited to a tension mechanism such as a spring/split clip or clothespin-type mechanism. A suitable tension mechanism may involve two-handed operation, such as is used in opening and closing a spring clip or clothespin, or may involve a slot or similar opening between two faces, with the slot or similar opening being thinner than the thickness of the marker and with the two faces being capable of being resiliently forced apart by insertion of the linear edge of the marker. Such tension mechanisms enable a marker to be readily inserted into the second end and securely held, while also being readily removable.

Figure 3C:
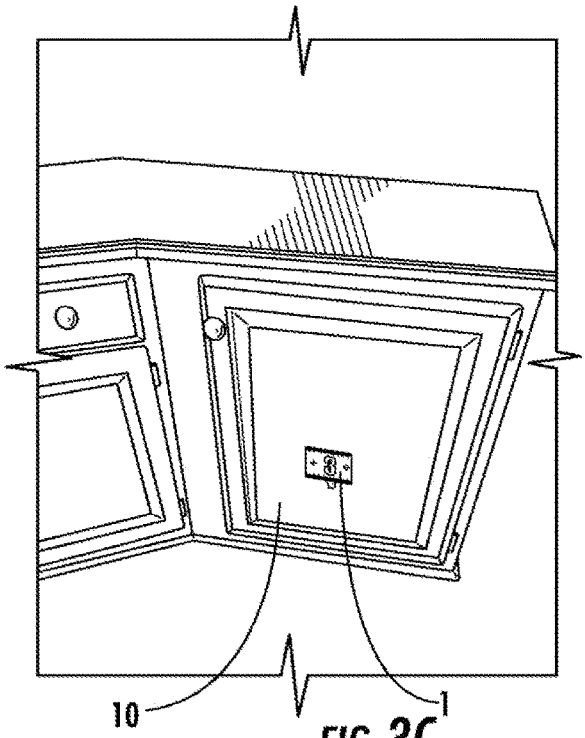
Figure 3D:
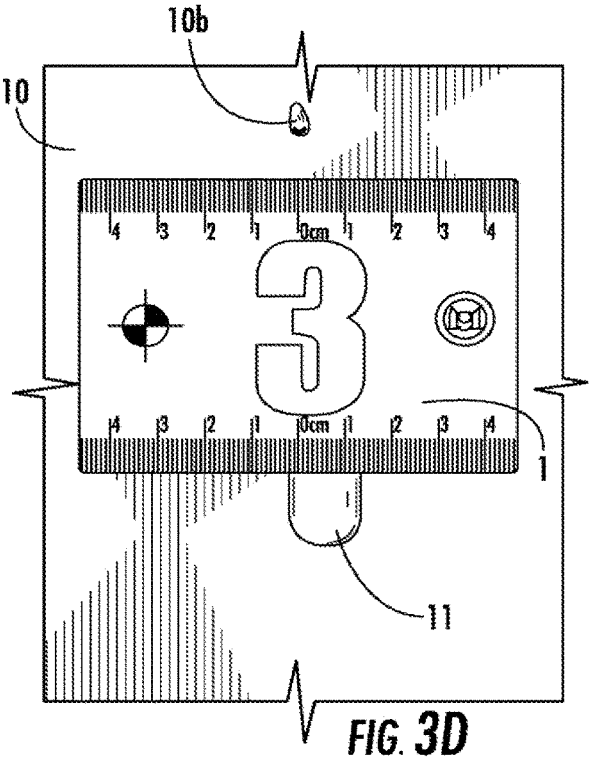

FIGS. 3C and 3D demonstrate how the present evidence markers may be affixed to a relatively flat surface 10 by means of a holder 11 affixed to the relatively flat surface, shown here in the form of the face of a cabinet. Holder 11 may be affixed to surface 10 in any suitable manner including, by way of non-limiting example, suction, adhesive, and magnetism. Holder 11, which may be made of any material including plastic, may hold evidence marker 1 by any suitable mechanism including an indentation in which evidence marker 1 rests. Alternatively, holder 11 may include walls and a groove formed therebetween for holding a marker 1, where each groove includes projections adapted to provide a gripping action for the marker.

Figure 4A:
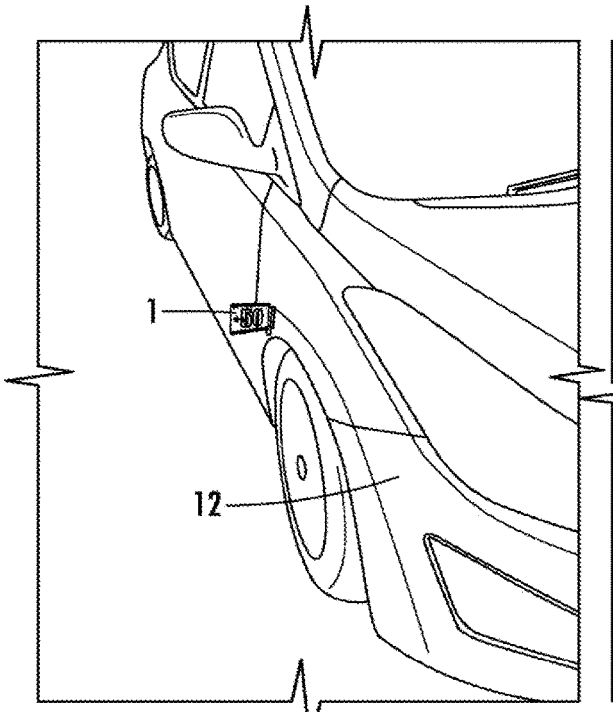
FIGS. 4A and 4B illustrate one embodiment of how the present evidence markers may be securely fastened to surfaces such as the fender of an automobile.
Figure 4B:
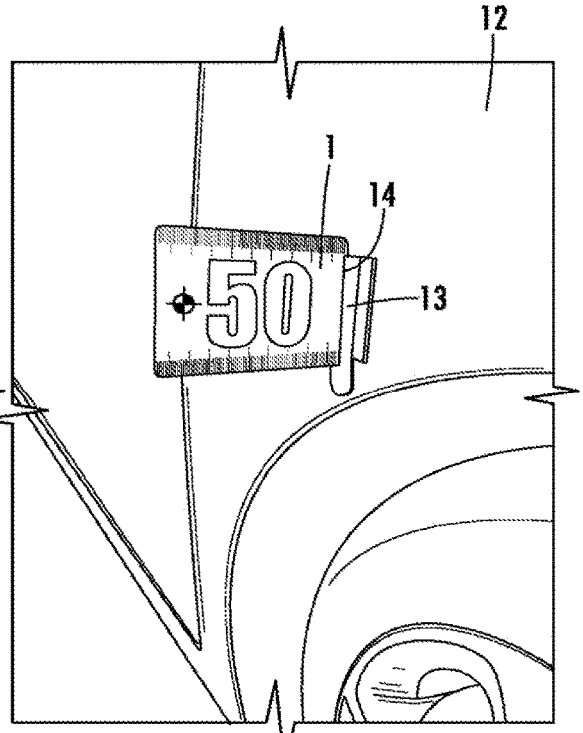

Further means of associating the present evidence markers with evidence is shown in FIGS. 4A-4B, demonstrating how evidence marker 1 may be associated with an object such as an automobile 12 by means of holder 13 bearing a groove 14. Evidence marker 1 slides or is inserted into groove 14, which holds marker 1 in place. Holder 13 may be secured or attached to automobile 12 by any suitable mechanism, including but not limited to adhesive, magnets, and a portion adapted to be inserted between trim or mold panels or hooked over a flange on a trim or body panel. The mechanism used to hold marker 1 in place is not limited to groove 14; other mechanisms, including adhesive, magnets, and tension may be used.

Figure 5A:
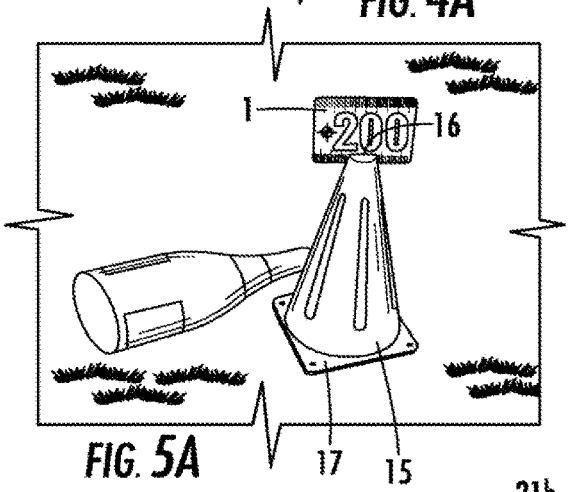
FIG. 5A illustrates the present evidence marker wherein a cone provides a stable means of mounting an evidence marker.
Figure 5B:
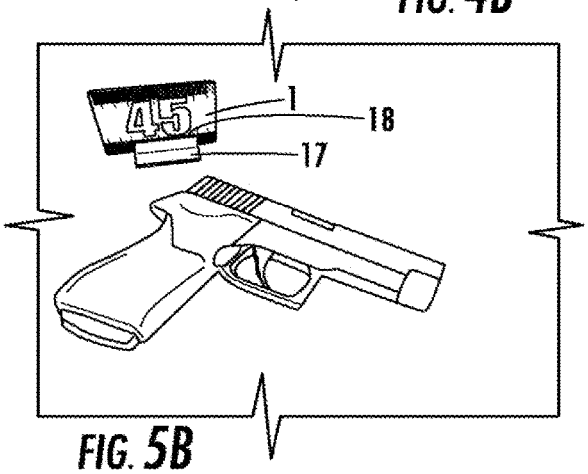
FIG. 5B depicts the present evidence marker mounted to a plastic holder.

Additional embodiments shown in FIGS. 5A and 5B, illustrate holder 15 having a base 17 for resting or anchoring the cone on or to the ground or other relatively flat surface. Cone 15 also may have a groove 16 which may be utilized to securely hold present evidence marker 1 on cone 15. In FIG. 5B, present evidence marker 1 is held by holder 15 comprising groove 18 and rectangular platform 19. Alternatively, any other suitable mechanism, such as adhesive, magnets, and tension, may be used to hold marker 1 on holder 15.

Figure 6:
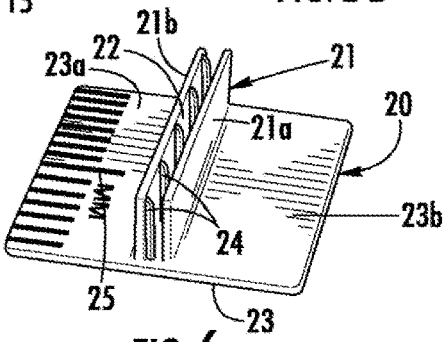
FIG. 6 shows an enlarged view of the present evidence marker holder.

FIG. 6 provides one embodiment of a stand or holder 20 used to hold present evidence marker 1 comprising platform 23. Platform 23 comprises raised portion 21 which may be located approximately equidistant from outer edges 23*a* and 23*b* of platform 23. Alternatively, raised portion 21 may be located at or near an edge of platform 23. Raised portion 21 comprises walls 21*a* and 21*b* located such that a groove 22 is formed therebetween for holding evidence marker card 1. Groove 22 comprises projections 24, which provide a gripping action for present evidence marker 1. Holder 20 may also comprise a scale 25 printed on one or both of outer edges 23*a* and 23*b*, for indicating the dimensions of the evidence holder 20 with which it is associated. Alternatively, platform 23 may be formed of a resilient material such that evidence marker 1 may be forced between them by hand, or such that exerting pressure downward on edge 23*a* and/or 23*b* causes walls 21*a* and 21*b* to move away from each other, whereupon a marker can be inserted between them, and the pressure on outer edges 23*a* and/or 23*b* can be released, thereby causing walls 21*a* and 21*b* to move towards each other and clasp evidence marker 1. It should also be noted that while platform 23 is depicted as substantially rectilinear and having a flat or planar lower surface, any suitable configuration may be used. For example, the perimeter of platform 23 may be circular, oval, square, rectangular, triangular, or any other suitable shape, and its lower surface may be substantially flat, or curved.

Figure 7:
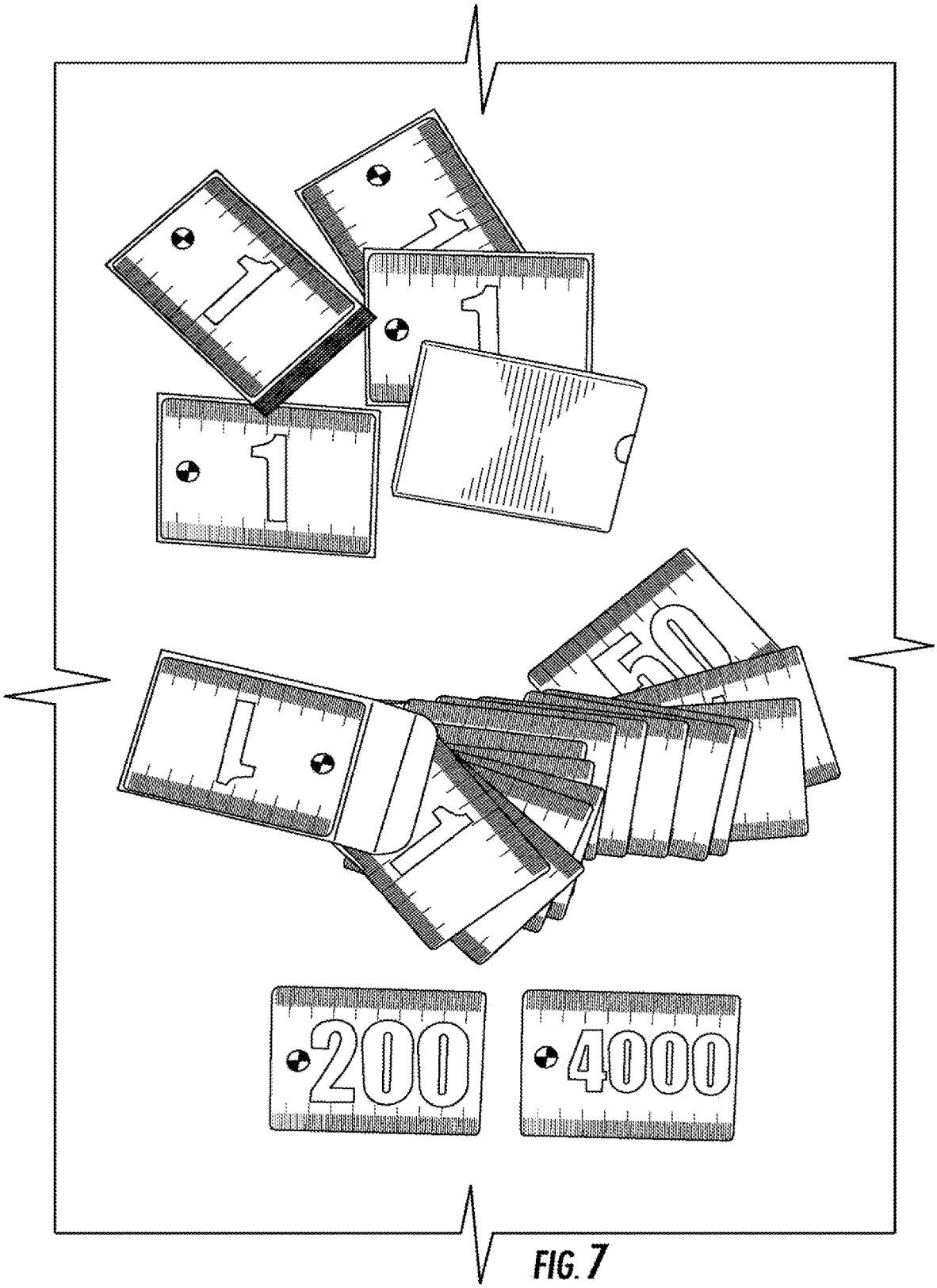
FIG. 7 provides the present evidence marker packaged as a crime scene investigation kit.

The present evidence markers may be supplied in packages or kits as shown in FIG. 7. The present evidence markers 1 may be provided in sequential order and numbered as high as desired. In addition to markers 1, the present evidence marker kits may contain other tools including one or more retractable tape measures, a compact foldable shovel or other similar tool such as a soil claw for digging when necessary, saws to clear branches and the like from outdoor areas where evidence may be found, sifting screens, and one or more magnifying glasses, as well as several evidence marker holders and fasteners.

An initial step in assembling a crime scene investigation kit using the present evidence markers is to print the evidence markers that will be part of the crime scene investigation kit. This entails first creating an electronic file containing the desired characteristics of the markers such as size, color, shape, and any desired graphic content. The file may utilize well-known software including Microsoft Word or Microsoft PowerPoint file. Alternatively, the evidence markers may be produced by custom software, capable of accepting parameters such as the format of the marker identifier (letter, number, alphanumeric) together with first and last values, pertaining to the range of identifier values (such as 1 to 1,000, A to ZZZZ, or A1-A50 to Z1-Z50). Whatever the choice of software, the output file may be printed to produce the markers on a suitable printing apparatus. Such software would preferably also be capable of outputting one or more additional files to: (1) replace missing markers, and/or (2) print additional markers having identifiers that begin where a prior set left off, in case it is realized that the existing set of markers is insufficient.

In addition, stands and holders may be produced for use with the present evidence marking set. The specific types and numbers of stands and holders may be selected based on the known or expected characteristics of a crime scene or may be a mix of types to provide a general-purpose kit for crime scenes that incorporate several types of evidence. The markers and any stands and holders may be packaged into an evidence kit for ready transport to a crime scene.

Once the crime scene kit is deployed to a crime scene, the use of each marker may be recorded; this may be done on paper. A checklist may be generated contemporaneously with use of the markers, reflecting the specific markers involved in sequential order, as well as a listing of the graphic content common to the markers, and/or a sample graphic representation of a marker. Alternatively, the markers can be scanned individually at the time of or after deployment; if after deployment, the markers can be scanned periodically in batches (such as 1-25, then 26-50 and so on), or after all have been deployed. The information on deployed markers can be reviewed and compared to any remaining markers in the evidence kit, as an integrity check to ensure that all markers are accounted for.

If the markers are scanned, they can be scanned in place after being placed at the crime scene so that the scan includes both the marker and the evidence being marked (shell casing, bullet hole, article of clothing, blood, etc.).

After use of the marking kit at the crime scene investigation is considered complete the markers may, depending on chain of custody policy, be (1) retained together, where practicable, with the associated evidence—for example, a shell casing and the associated marker may be placed in the same evidence container; (2) destroyed; or (3) retained for use in a later crime scene investigation.

The record of markers used at a crime scene (whether paper or electronic), may be used in connection with the electronic file that was used to print the markers in order to print a replacement set and restore the evidence kit to full capacity. For example, if an evidence kit is prepared containing markers 1-500, and the crime scene uses markers 1-348, the electronic file may be configured to re-print markers 1-348 in order to restore the evidence kit to full capacity. Thus, in one embodiment, an electronic file may be prepared and used to print a desired number of markers having selected graphic content. The markers may be combined with a set of holders and stands of different types to prepare an evidence kit. The evidence kit will be deployed at a crime scene, with each used marker being scanned to create a record of which particular markers from the kit were used. If there are not enough markers in the evidence kit, the electronic file can be used to produce additional markers that continue the sequence present in the existing markers. The record of used markers may be used to produce a new or revised electronic file that can then be used to print a replacement set of the markers used at the crime scene, restoring the evidence kit to full capacity.

Although the present crime scene evidence marking components and method have been described with reference to particular embodiments, it is to be understood that these embodiments are merely illustrative of the principles and applications disclosed herein. For example, the present evidence markers may be of any suitable material and color, and may present any desired information in alphabetic, numeric, alphanumeric, and/or graphic form. It is therefore to be understood that numerous modifications may be made to the illustrative embodiments and that other arrangements may be devised without departing from the spirit and scope of the present disclosure.

The invention claimed is:

1. A marking system for marking evidence at a scene comprising:

a plurality of markers each having: a single wall having a thickness of between about 0.127 and about 1.270 millimeters;

at least one linear edge;

at least one measurement indicia;

a sequential marker identification;

a logo;

a progress indicator for indicating the current status for a piece of evidence;

an index for indication of orientation; and, a plurality of holders comprising walls and a groove formed therebetween for holding a marker, wherein each groove includes projections adapted to provide a gripping action for the marker to secure the plurality of markers in a marking environment, the holders further comprising a scale printed on an outer edge of a base surface for indicating the dimensions of the holder and the base having a mounting surface having at least one of an adhesive or a magnet.

2. The marking system of claim 1 wherein each of the plurality of markers has the same thickness.

3. The marking system of claim 1 wherein said thickness is from about 0.170 to about 0.330 millimeters.

4. The marking system of claim 1 wherein the holder comprises a two-sided strip of removeable adhesive.

5. The marking system of claim 1 wherein the holder groove is adapted to hold the linear edge of a marker through tension on the linear edge.

* * * * *